US007201560B2

(12) United States Patent
O'Clair et al.

(10) Patent No.: US 7,201,560 B2
(45) Date of Patent: Apr. 10, 2007

(54) MOUNTING STRUCTURE FOR A PACKING RING SEAL SEGMENT IN A TURBINE

(75) Inventors: Charles Thomas O'Clair, Waterford, NY (US); Richard Jon Chevrette, Troy, NY (US); Carl A. Greco, Guilderland, NY (US); Jeyaruban Amirtharajah, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 191 days.

(21) Appl. No.: 11/003,454

(22) Filed: Dec. 6, 2004

(65) Prior Publication Data

US 2006/0120861 A1 Jun. 8, 2006

(51) Int. Cl.
*F01D 11/02* (2006.01)

(52) U.S. Cl. ..... 415/174.2; 415/231

(58) Field of Classification Search ..... 415/174.5, 415/173.7, 174.2, 230, 231; 277/412
See application file for complete search history.

(56) References Cited

U.S. PATENT DOCUMENTS 1,651,855 A * 12/1927 Warren ..... 415/173.7

* cited by examiner

*Primary Examiner*—Richard A. Edgar
(74) *Attorney, Agent, or Firm*—Nixon & Vanderhye P.C.

(57) ABSTRACT

A packing ring holder assembly for packing seal segments about a steam turbine rotor includes a nozzle box and a holder cooperable to form a dovetail for securing packing ring segments to the nozzle box. A spring is interposed between the nozzle box and packing ring segment to bias the latter radially inwardly for sealing with the rotor. The holder includes a shoulder for preventing axial movement of the spring in one direction.

12 Claims, 3 Drawing Sheets

MOUNTING STRUCTURE FOR A PACKING RING SEAL SEGMENT IN A TURBINE

The present invention relates to turbines having a packing ring seal about a rotor and particularly relates to steam turbines having a nozzle box and packing ring holder secured thereto for securing the packing ring seal about the turbine rotor.

BACKGROUND OF THE INVENTION

In steam turbines, a nozzle box is used to change the direction of steam flowing into the turbine from a generally radial direction to an axial direction for flow through the various stages of the turbine. The nozzle box surrounds the turbine rotor and packing ring seals are typically used to seal between the nozzle box and the rotor. Because of reduced clearance with the rotor, certain nozzle boxes have required a split packing ring holder assembly to retain the shaft seal packings, i.e. the sealing segments about the rotor. These prior packing ring holder assemblies each included a relatively thin annular piece terminating at axially opposite ends in radially extending flanges. A second piece of the holder assembly bolted and clamped one of the flanges of the first piece between the second piece and the nozzle box. The first and second pieces had axially extending flanges which cooperated with a generally dovetail shaped sealing segment to secure the sealing segment in sealing relation to the rotor. Each sealing segment carried labyrinth seal teeth for sealing relative to the rotor.

Because of the limitations of space between the nozzle box and the rotor, the packing ring tended to become unstable. The packing ring segments were generally spring biased toward the rotor and the springs tended to be off center. The thin annular ring also had a tendency to bend. As a consequence, the seal packing was unstable, tended to vibrate, increased the difficulty of installation in the field and had longer outage times during repair and replacement. Consequently, there has developed a need for a packing ring sealing assembly for a steam turbine having, inter alia, increased sealing segment stability, easier installation and shortened outage time.

BRIEF DESCRIPTION OF THE INVENTION

In a preferred embodiment of the present invention, there is provided a packing assembly for a steam turbine comprising: a nozzle box for facilitating flow of steam into a first stage of the turbine and including an arcuate groove; an arcuate packing ring segment about an axis of the turbine and including a seal face for sealing against a rotor of the turbine; and a packing ring segment holder secured to the nozzle box, the nozzle box and the holder having surfaces cooperable with the segment to secure the segment to the nozzle box and holder substantially against relative axial movement and with portions of said segment in said groove.

In a further preferred aspect of the present invention, there is provided a packing assembly for sealing about a rotor of a steam turbine comprising: a nozzle box for facilitating flow of steam into a first stage of the turbine; an arcuate packing ring segment about an axis of the turbine and including a seal face for sealing about the rotor, a pair of axially extending flanges and a neck between the seal face and the flanges; the nozzle box including a first flange and extending toward the packing ring segment in a first axial direction and lying on one axial side of the segment; and a packing ring segment holder secured to the nozzle box and extending along an opposite side of the segment, the holder having a second flange extending axially toward the packing ring segment in a second axial direction opposite the first axial direction; the segment being secured to the nozzle box with the first and second flanges of the nozzle box and the holder respectively located radially inwardly of the packing ring segment flanges to secure the segment and the nozzle box to one another.

DETAILED DESCRIPTION OF THE INVENTION

Figure 1:
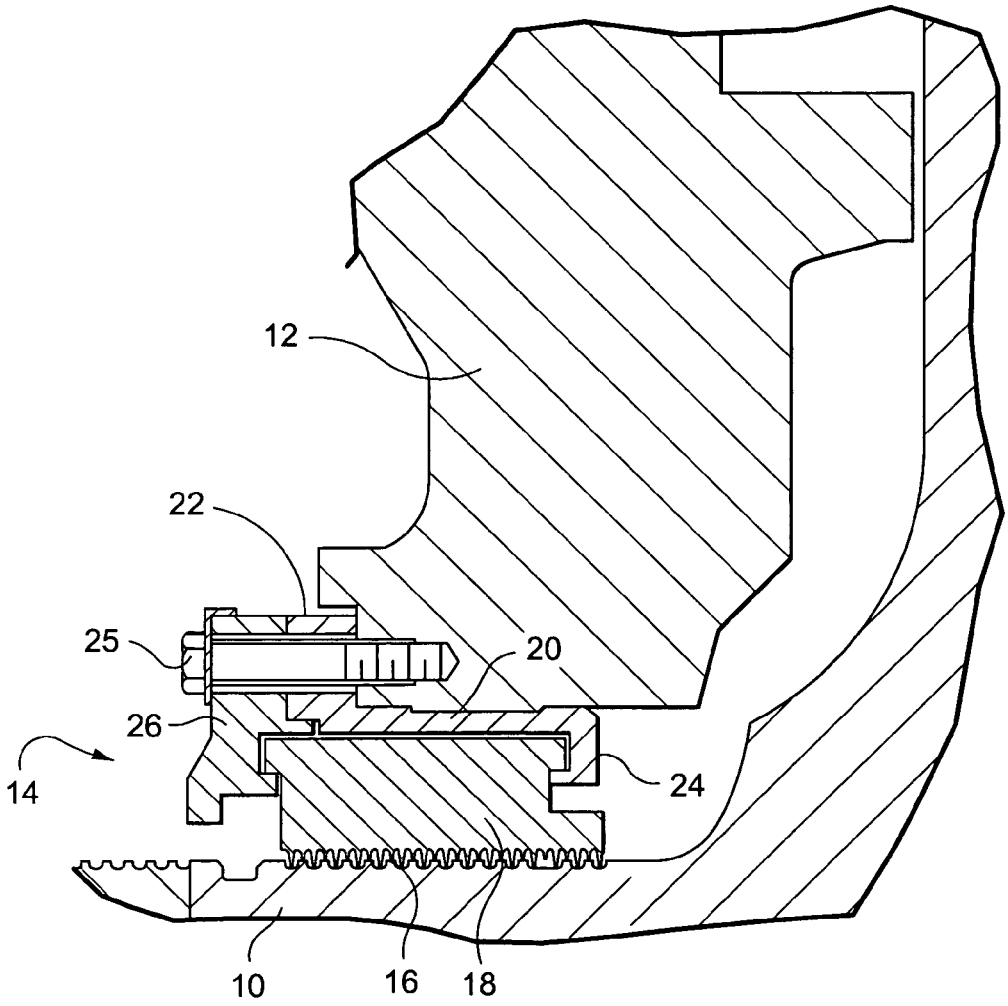
Fig. 1 (PRIOR ART)
FIG. 1 is a fragmentary cross-sectional view illustrating a prior art packing ring seal holder assembly for securing a packing ring segment to a nozzle box for sealing about a steam turbine rotor.

Referring now to FIG. 1, there is illustrated the shaft 10 of a steam turbine having a nozzle box 12 surrounding the shaft 10. It will be appreciated that the nozzle box 12 enables the steam flowing into the turbine to change direction from a generally radial inward direction to an axial direction such that the steam flows generally axially into the initial stage of the steam turbine. In the prior art illustration of FIG. 1, a packing seal assembly is illustrated sealing between the nozzle box and the rotor 10. The seal assembly generally designated 14 includes a two part holder assembly secured to the nozzle box 12 for securing an arcuate sealing segment 18 in sealing relation about rotor 10. The sealing segment 18 preferably comprises a plurality of segments for example six in number, each extending approximately 60° and having labyrinth seal teeth 16 along its sealing face for sealing about the rotor 10. The seal ring segments 18 have a generally dovetail connection with the two part seal holder assembly 14.

The seal holder assembly 14 included a first arcuate piece 20 having generally radially directed flanges 22 and 24 adjacent opposite ends. The first piece 20 is secured to the nozzle box 12 by bolts 25 passing through a holder 26 and through the flange 22 of the first piece 20. The second flange 24 and the holder 26 included axially extending flanges for cooperation with a dovetail connection on the sealing segment 18 to secure the seal segment against axial movement while enabling limited radial movement under the bias of a spring, not shown. As explained previously, the two part assembly became unstable and tended to become distorted. Additionally the spring tended to move off center and generally the two part holder assembly tended to bend resulting in steam leakage paths about the seal ring segment.

Figure 2:
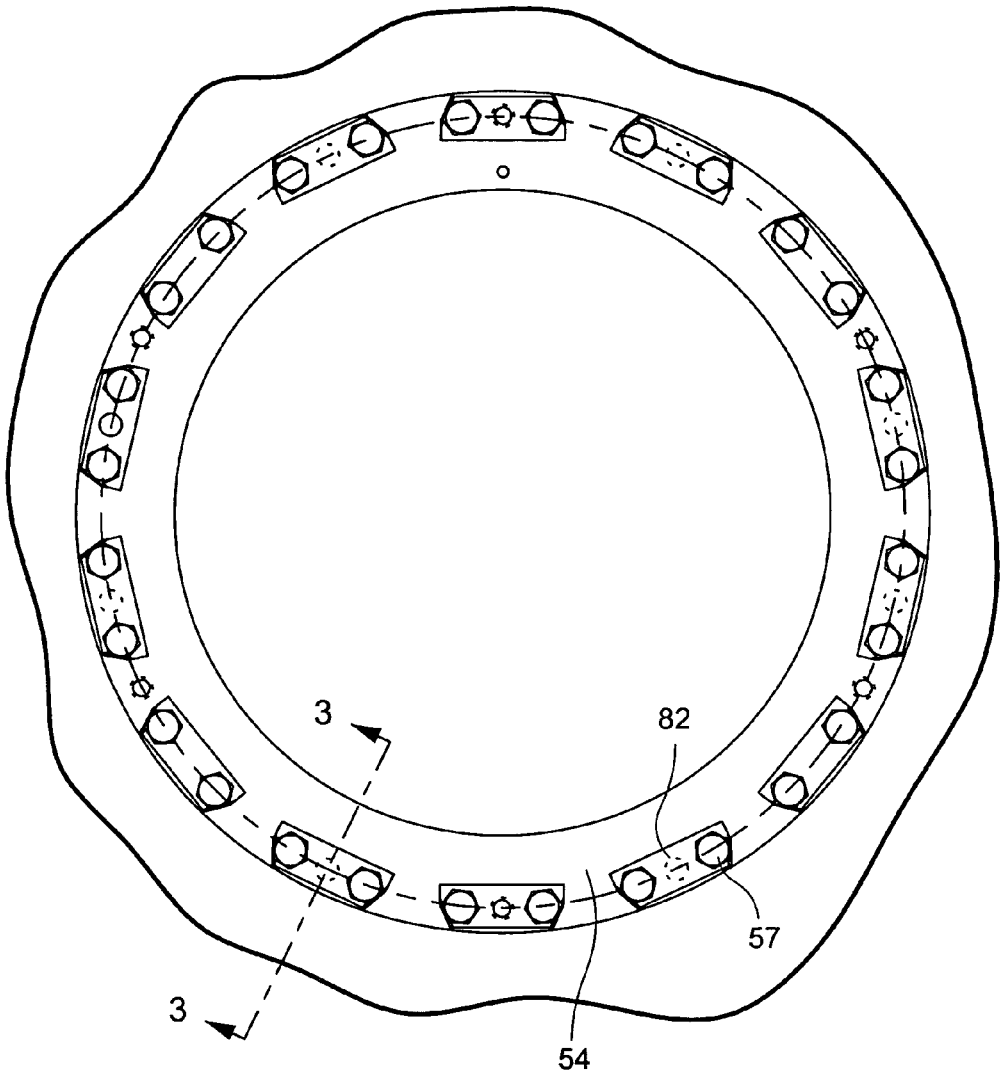
FIG. 2 is a fragmentary cross-sectional view of a packing seal ring holder assembly for steam turbines in accordance with a preferred embodiment of the present invention.
Figure 3:
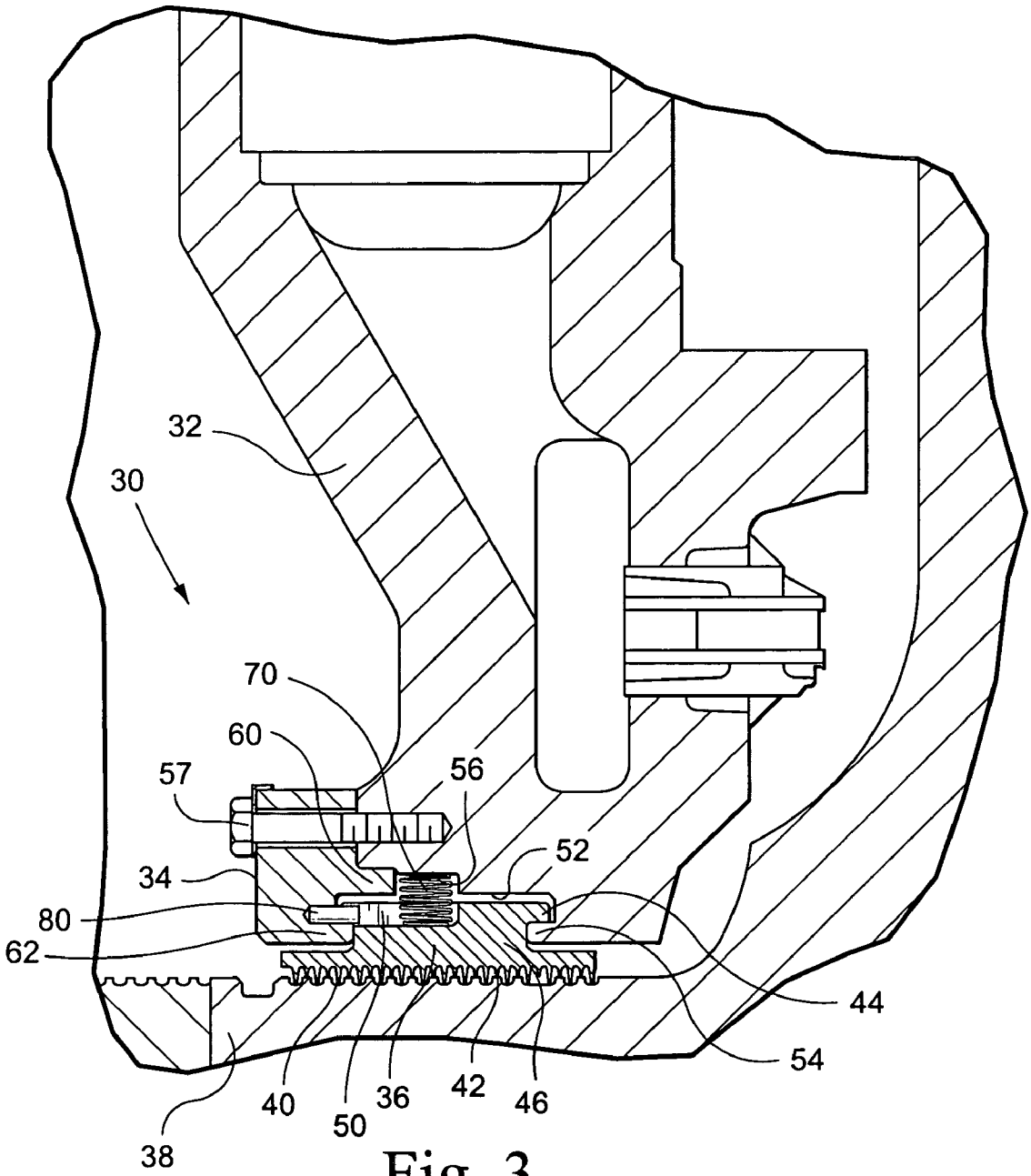
FIG. 3 is a partial axial view of the assembly of FIG. 2.

Referring now to FIGS. 2 and 3, there is illustrated a packing ring holder assembly generally designated 30 in accordance with a preferred embodiment of the present invention. The packing ring holder assembly 30 is comprised of the nozzle box 32 and a holder 34 for securing a sealing segment 36 in sealing relation to the rotor 38. The sealing segment 36 comprises one of a plurality of arcuate sealing segments 36, for example six in number, each 60° in circumferential extent about the rotor and secured to the nozzle box. The sealing segment 36 includes a plurality of labyrinth teeth 40 on the seal face 42 of the segment 36 for sealing about rotor 38. The sealing segment 36 includes a dovetail along its radial outer side including a pair of axially extending flanges 44 defining a neck portion 46 between the flanges and the seal face 42. The surface of the seal segment 36 opposite the seal face 42 includes an axial extending slot 50 adjacent each of the opposite ends of the segment for reasons which will become clear.

A groove 52 is formed along the inner radial face of the nozzle box 32. The groove is defined in part by a flange 54 extending axially toward the seal segment 36. The groove 52 also includes a circumferentially extending slot 56 of greater diameter than the groove 52 and opening in an axial direction.

The seal holder 34 comprises arcuate segments which are secured by bolts 57 to an axial face of the nozzle box. The segments of the holder 34 may have different lengths than the seal segments 36 for example two segments of about 90° each in the upper half of the turbine and one segment of about 180° in the lower half of the turbine. The seal holder 34 includes an axially extending flange or shoulder 60 and a radially inner axially extending flange 62. As illustrated, the flange 54 of the nozzle box and the flange 62 of holder 34 extend axially toward one another and constitute surfaces received in the dovetail of the sealing segments to retain the seal segments on the nozzle box.

A pair of springs preferably coil springs 70 are provided in the groove 52 of the nozzle box 32 adjacent opposite ends of each seal segment 36 to bias the seal segments 36 in a radial inward direction. Particularly, the radial outer ends of the coil springs 70 are captured against axial movement in one direction in the slot 56 by the flange or shoulder 60 of the holder 34 and against axial movement in an opposite direction by a margin of the slot. The radial inner end of each spring 70 is captured against circumferential movement by the slot 50 formed in the radial outer surface of the segment 36.

In a preferred embodiment, the holder 34 and nozzle box 32 are secured to one another by the bolts 57 during the manufacture of the original equipment. The groove 52 is preferably formed concurrently in the holder and nozzle box after the holder is initially secured to the nozzle box. In this manner the holder 34 can be removed from the nozzle box after formation of the groove and reinstalled in the field with the groove 52 being precisely and accurately reestablished for fit about the seal segment 36.

A packing anti-rotation pin 80 is disposed between the seal ring segment 36 and the holder 34 to prevent relative circumferential movement of the segment and holder as well as between the segment and the nozzle box. As illustrated in FIG. 2, lock washers 82 are applied between the bolt heads and the holder 34 with edges being peened to preclude rotation of the bolts during usage.

It will be appreciated that the nozzle box 32 is configured as part of the direct securement of packing ring segment to the nozzle box. That is, the nozzle box forms part of the attachment mechanism necessary to secure the packing ring segment to the nozzle box. This in turn enables the use of a more robust holder 34 and avoids use of an intermediate piece between the nozzle box and packing ring segment as in the prior art. The present holder assembly thus provides additional stability, and a reduced tendency for vibration. The increased thickness of the bolted holder 34 and the overall configuration of the mounting structure substantially eliminates any tendency toward the establishment of leakage paths as in the prior art assembly.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A packing assembly for a steam turbine comprising:

a nozzle box for facilitating flow of steam into a first stage of the turbine and including an arcuate groove;

an arcuate packing ring segment about an axis of the turbine and including a seal face for sealing against a rotor of the turbine;

a packing ring segment holder secured to said nozzle box, said nozzle box and said holder having surfaces cooperable with said segment to secure the segment to the nozzle box and holder substantially against relative axial movement and with portions of said segment in said groove; and a spring in said groove between said nozzle box and said segment for biasing the segment in a radial inward direction toward said rotor.

2. A packing assembly according to claim 1 wherein said nozzle box includes a first flange extending axially toward and on one side of said segment, said holder including a second flange extending axially toward and on an opposite side of said segment, said segment having a dovetail cooperable with said first and second flanges for securing said segment to the nozzle box and holder.

3. A packing assembly according to claim 1 wherein said groove has a slot, with one end of said spring in said slot, said holder including a shoulder in said slot preventing axial displacement of aid spring from said groove.

4. A packing assembly for sealing about a rotor of a steam turbine comprising:

a nozzle box for facilitating flow of steam into a first stage of the turbine;

an arcuate packing ring segment about an axis of the turbine and including a seal face for sealing about the rotor, a pair of axially extending flanges and a neck between said seal face and said flanges;

said nozzle box including a first flange and extending toward said packing ring segment in a first axial direction and lying on one axial side of said segment; and a packing ring segment holder secured to said nozzle box and extending along an opposite side of said segment, said holder having a second flange extending axially toward said packing ring segment in a second axial direction opposite said first axial direction;

said segment being secured to said nozzle box with the first and second flanges of said nozzle box and said holder respectively located radially inwardly of said packing ring segment flanges to secure the segment and the nozzle box to one another; and an anti-rotation pin between said holder and said segment to preclude relative circumferential rotation therebetween.

5. An assembly according to claim 4 including bolts securing said holder to said nozzle box.

6. An assembly according to claim 4 wherein said nozzle box includes a groove for receiving a portion of said segment, a spring in said groove and between said nozzle box and said segment for biasing the segment for movement in a generally radial inward direction.

7. An assembly according to claim 6 wherein said holder includes a shoulder radially outwardly of said second flange and engageable with a portion of said spring to preclude movement of said spring at least in one axial direction.

8. An assembly according to claim 6 including a slot in said groove for receiving a radial outer end of said spring.

9. An assembly according to claim 4 wherein said nozzle box includes a groove for receiving a portion of said segment, a pair of coil springs in said groove and between said nozzle box and said segment for biasing the segment for movement in a generally radial inward direction, said holder including shoulders radially outwardly of said second flange and engageable with portions of said springs to preclude movement of said springs in at least one axial direction.

10. An assembly according to claim 4 wherein said seal face includes a plurality of labyrinth seal teeth.

11. An assembly according to claim 4 including a plurality of dowel pins at circumferentially spaced locations connecting between said holder and said nozzle box.

12. An assembly according to claim 4 wherein said nozzle box includes a groove for receiving a portion of said segment, a pair of coil springs in said groove and between said nozzle box and said segment for biasing the segment for movement in a generally radial inward direction, said holder including shoulders radially outwardly of said second flange and engageable with portions of said springs to preclude movement of said springs in at least one axial direction, said groove including a slot for receiving radial outer ends of said springs and precluding movement of said spring in an opposite axial direction to said one axial direction.

* * * * *